US010433707B2

(12) United States Patent
DeSimone

(10) Patent No.: US 10,433,707 B2
(45) Date of Patent: Oct. 8, 2019

(54) LINT ROLLER COVER

(71) Applicant: Helen Ann DeSimone, Little Falls, NJ (US)

(72) Inventor: Helen Ann DeSimone, Little Falls, NJ (US)

( * ) Notice: Subject to any disclaimer, the term of this patent is extended or adjusted under 35 U.S.C. 154(b) by 364 days.

(21) Appl. No.: 15/084,411

(22) Filed: Mar. 29, 2016

(65) Prior Publication Data

US 2016/0278609 A1 Sep. 29, 2016

Related U.S. Application Data

(63) Continuation-in-part of application No. 14/626,554, filed on Feb. 19, 2015, now Pat. No. 9,717,394.

(51) Int. Cl.
*B65D 65/02* (2006.01)
*A47L 25/00* (2006.01)

(52) U.S. Cl.
CPC ..... *A47L 25/005* (2013.01)

(58) Field of Classification Search
CPC ..... B65D 81/3886; B65D 25/34; A61G 5/10; B62D 1/06; E04G 21/30; A47L 25/005
USPC ..... 150/154–168; 15/104.001, 104.002, 15/104.2, 104.94, 118, 246, 247; 206/349, 361, 362.2, 362.3
See application file for complete search history.

(56) References Cited

U.S. PATENT DOCUMENTS 2,301,586 A 11/1942 Rubin
2,346,908 A 4/1944 Lincoln, Jr.
3,197,830 A * 8/1965 Hoadley ..... F16L 3/233 24/16 PB
3,421,170 A 1/1969 Frank, Jr.
4,501,354 A * 2/1985 Hoffman ..... A47K 5/00 206/499
4,606,456 A 8/1986 Kaminski
5,226,544 A 7/1993 Gallucci et al.
5,878,457 A * 3/1999 Cox ..... A47L 25/005 15/104.002
D458,743 S * 6/2002 Brookhouse ..... D3/206
D489,035 S * 4/2004 Butler ..... D12/401
7,114,213 B2 10/2006 DeRoma
7,188,384 B2 3/2007 McKay
7,823,244 B2 * 11/2010 Knopow ..... A47L 25/08 15/104.002
7,841,036 B2 11/2010 Smith
D631,244 S * 1/2011 Ferrence ..... D3/205
9,717,394 B2 * 8/2017 Desimone ..... A47L 25/005
2002/0139823 A1 * 10/2002 Johnson ..... A45C 13/26 224/250
2004/0194240 A1 10/2004 McKay
2005/0235446 A1 10/2005 Eggers
2008/0110780 A1 5/2008 Hogg
(Continued)

*Primary Examiner* — Fenn C Mathew
*Assistant Examiner* — Cynthia F Collado
(74) *Attorney, Agent, or Firm* — Charney IP Law LLC

(57) ABSTRACT

A lint remover cover is provided. The cover is a substantially flat and bendable sheet having a first end, a second end, an upper surface, a lower surface, and an edge about the perimeter. A strap is attached to the upper surface and protrudes past the edge on the first end. A connector is attached to the upper surface near the second end and releasably attaches to the strap. The cover is wrapped around a lint roller covering the adhesive tape. The strap connects to the connector to further secure the cover to the lint roller.

20 Claims, 6 Drawing Sheets

(56) References Cited

U.S. PATENT DOCUMENTS

| | | | | |
|---|---|---|---|---|
| 2009/0008005 | A1 | 1/2009 | Chu | |
| 2009/0162596 | A1 | 6/2009 | Rios et al. | |
| 2011/0005647 | A1* | 1/2011 | Campfield | B65D 65/10 150/154 |
| 2012/0277682 | A1* | 11/2012 | Corato | A61M 5/1418 604/179 |
| 2012/0284939 | A1* | 11/2012 | Anderson | B65D 43/162 15/104.002 |

* cited by examiner

LINT ROLLER COVER

CROSS-REFERENCE TO RELATED APPLICATIONS

The present application is a continuation-in-part of U.S. patent application Ser. No. 14/626,554 filed Feb. 19, 2015, entitled "LINT ROLLER COVER," the disclosure of which is hereby incorporated by reference herein.

BACKGROUND OF THE INVENTION

The present invention relates to lint rollers and, more particularly, to a lint roller cover.

A lint roller or lint remover is a roll of one-sided adhesive paper on a cardboard or plastic barrel that is mounted on a central spindle, with an attached handle. The device facilitates the removal of lint or other small fibers from most materials such as clothing, upholstery and linen. Once expended, the roll can typically be replaced with a "refill" roll. When storing a lint roller, debris tends to stick on the new adhesive sheet. Therefore, when the user is ready to use the lint roller, a new sheet must be wasted.

As can be seen, there is a need for a cover for the lint roller that is quick, easy to use and inexpensive.

BRIEF SUMMARY OF THE INVENTION

In one aspect of the present invention, a lint remover cover comprises: a substantially flat sheet having a first end, a second end, an upper surface, a lower surface, and an edge about the perimeter; a strap attached to the upper surface, and protruding past the edge on the first end; and a connector attached to the upper surface near the second end and releasably attachable to the strap.

In another aspect of the present invention, a method of covering a lint remover comprises: providing a cover comprising: a substantially flat sheet having a first end, a second end, an upper surface, a lower surface, and an edge about the perimeter; a strap attached to the upper surface, and protruding past the edge on the first end; and a connector attached to the upper surface near the second end; wrapping the cover around a lint roller so that the lower surface is facing towards an adhesive tape of the lint roller; attaching the strap to the connector, thereby securing the cover on the lint roller.

In another aspect of the invention, a lint remover cover comprises a substantially flat sheet having a first end, a second end, an upper surface, a lower surface, and an edge about the perimeter; a strap extending from the first end of the sheet, the strap including at least one interference member; and a connector attached to the sheet toward the second end of the sheet, the connector having a portion adapted to interfere with the at least one interference member such that the strap may be releasably retained by the connector.

The substantially flat sheet may be made of silicone.

The connector may comprise a first end and a second end each attached to the upper surface of the sheet and forming an opening in between, wherein the strap fits within the opening to be releasably retained. In such case, the connector may be substantially perpendicular to the strap.

The at least one interference member may be a series of interference members. In such case, the series of interference members may be a series of ribs.

The portion of the connector adapted to interfere with the at least one interference member may be a protrusion.

The at least one interference member may be a series of ribs separated by valleys and the at least one interference member may be adapted to fit into one of the valleys.

The lint remover cover may further comprise a second connector attached to the sheet toward the second end of the sheet, the second connector having a portion adapted to interfere with the at least one interference member such that the strap is releasably retained by either the connector or the second connector.

In another aspect of the invention, a method of covering a lint roller comprises the steps of providing a cover comprising a substantially flat sheet having a first end, a second end, an upper surface, a lower surface, and an edge about the perimeter, a strap attached to the edge on the first end, the strap including an interference member, and a connector attached to the sheet near the second end, the connector having an opening through which the strap may be threaded, the opening including a portion adapted to interfere with the interference member; wrapping the cover around the lint roller so that the lower surface is facing towards an adhesive tape of the lint roller; and threading the strap through the opening of the connector such that the portion of the connector adapted to interfere with the interference member does so, thereby securing the cover on the lint roller.

These and other features, aspects and advantages of the present invention will become better understood with reference to the following drawings, description and claims.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

DETAILED DESCRIPTION

Figure 1:
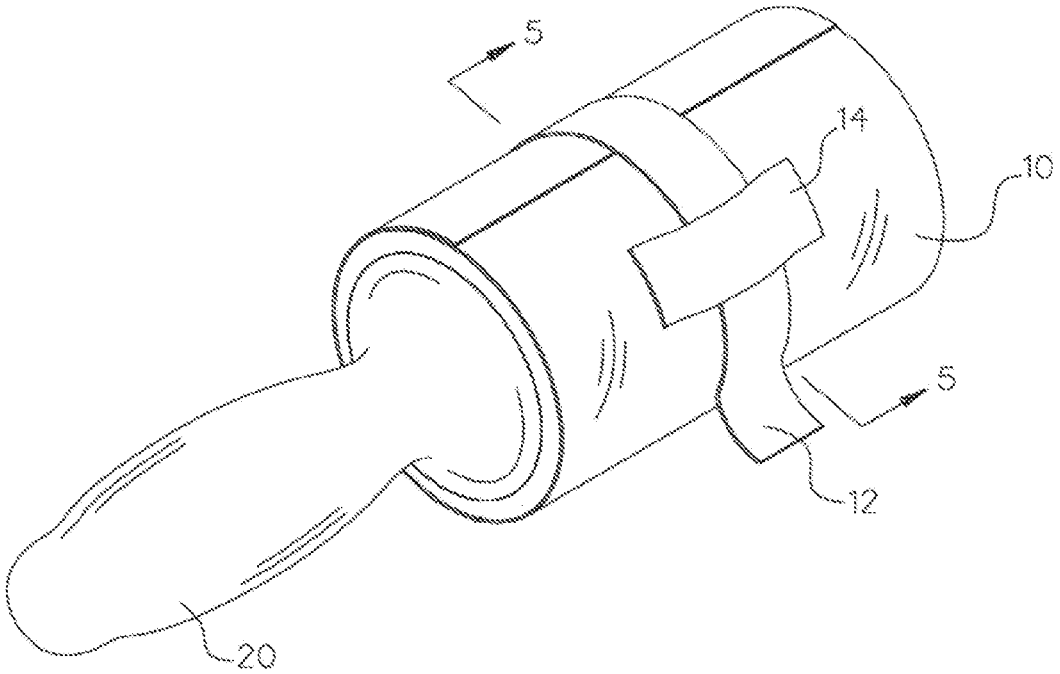
FIG. 1 is a perspective view of an embodiment of the present invention shown in use.
Figure 2:
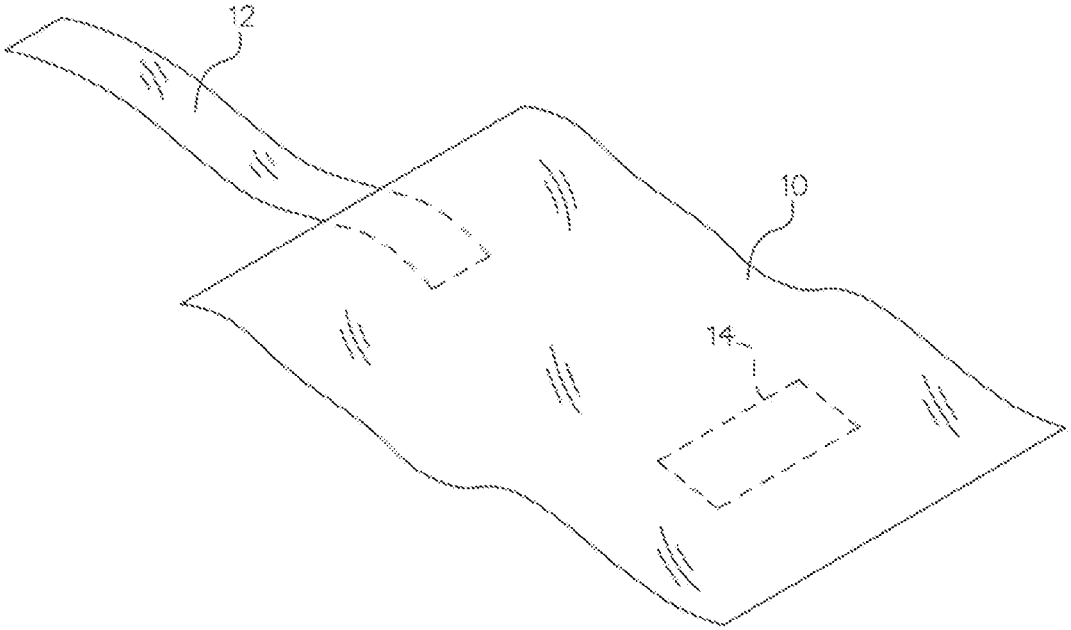
FIG. 2 is a perspective view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a protective covering, also referred to as a "barrier," for adhesive type lint removers. This preferably silicone or plastic cover protects the adhesive lint removal sheet by covering it when not in use. The connector of the present invention allows the barrier to be secured around the adhesive portion of the lint remover and protect the lint roller. The preferably silicone or plastic barrier is wrapped around the adhesive portion of the lint roller and is then secured in place with the connector. It will be appreciated that the barrier, particularly if formed from silicone, may be stretchable but resilient.

Referring to FIGS. 1 through 6, the present invention includes a lint remover cover 10. The cover 10 is a substantially flat and bendable sheet having a first end, a second end, an upper surface, a lower surface, and an edge about the perimeter. A strap 12 is attached to the upper surface and protrudes past the edge on the first end. A connector 14 is attached to the upper surface near the second end and releasably attaches to the strap 12. The cover 10 is wrapped around a lint roller 20 covering the adhesive tape 18. The strap 12 connects to the connector 14 to further secure the cover 10 to the lint roller 20.

The cover 10 may be made of silicone or other polymer, such as bendable plastics. In certain embodiments, the connector 14 includes a first end and a second end each attached to the upper surface and forming a loop in between. The strap 12 fits within the loop to releasably attach to the connector 14. The connector 14 is substantially perpendicular to the strap 12 so that the opening of the loop is able to easily receive the strap 12 once the cover 10 has been wrapped around the adhesive tape 18.

A method of covering a lint roller 20 may include the following. The cover 10 mentioned above is provided. The cover 10 is wrapped around the lint roller cylinder so that the lower surface of the cover 10 is facing towards the adhesive tape 18 of the lint roller 20. The strap 12 is then attached to the connector 14 by inserting the strap 12 into the loop.

It should be understood, of course, that the foregoing relates to exemplary embodiments of the invention and that modifications may be made without departing from the spirit and scope of the invention as set forth in the following claims.

Referring to FIGS. 7 through 12, a further embodiment of the present invention includes a lint remover cover 100. The cover 100 is a substantially flat and bendable sheet, preferably formed from silicone and having a first end 102, a second end 104, an upper surface 106, a lower surface 108, and an edge 110 about the perimeter. A strap 120 is formed from the flat and bendable sheet and protrudes past the edge 110 on the first end 102. A pair of connectors 140A, 140B are formed by the flat and bendable sheet and protrude above the upper surface 106 near the second end 104. These connectors 140A, 140B are adapted to releasably attach to the strap 120.

Figure 11:
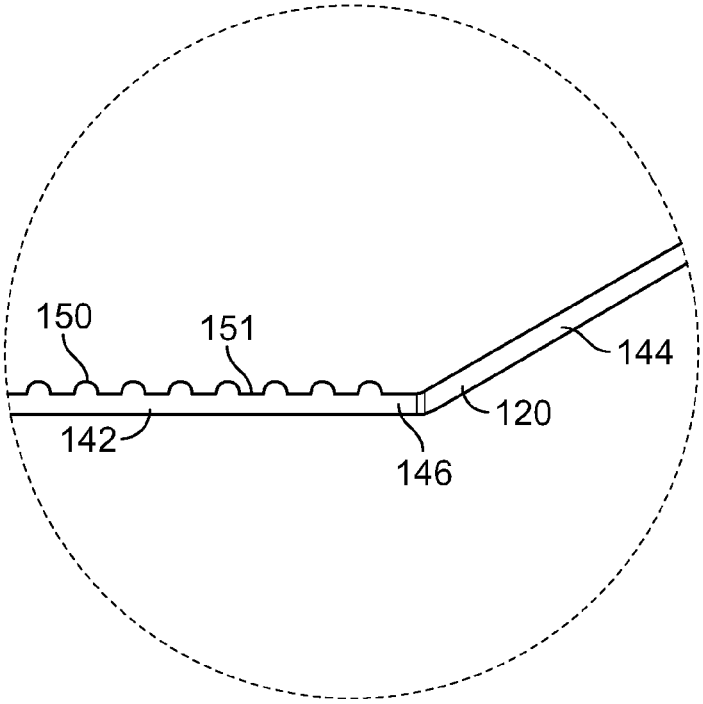
FIG. 11 is an enlarged view of a portion of FIG. 10.

As shown in FIG. 11, the strap 120 includes a first portion 142 and a second portion 144, where the first portion is closest to the first end 102 of the cover 100. Between the first portion 142 and the second portion 144 is a living hinge 146, adapted such that the second portion extends upwardly at an angle above the upper surface 106 of the cover. The distal end 148 of the second portion preferably is curved about 180 degrees.

Within the first portion 142 are at least one interference member, and preferably a series of interference members, shown here in the form of ribs 150 extending across the upper surface 106 along the width of the first portion. In other embodiments, the interference members may be rounded bumps, squared walls, ramped walls, or the like. In the embodiment shown, the ribs 150 are constructed as raised protrusions with spaces, or valleys 151, between each.

Figure 12:
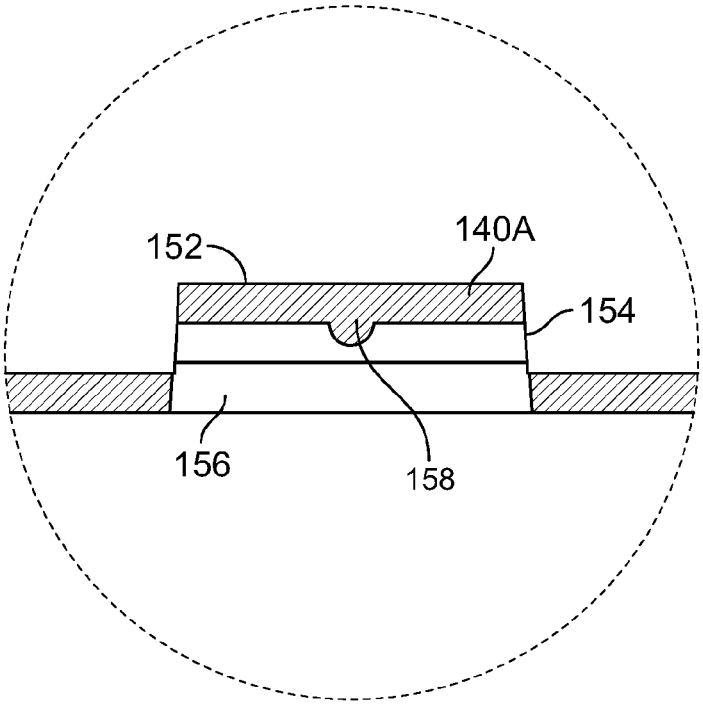
FIG. 12 is an enlarged view of a portion of FIG. 10.

As shown in FIG. 12, the connector 140A (and, incidentally, connector 140B) includes an upper portion 152 raised above the upper surface 106 of the cover 100 by standoff members 154. The standoff members 154 may be vertical in relation to the upper surface 106 of the cover 100 or may be angled as shown in the figures, for example FIG. 7. It will be appreciated that the upper portion 152 and standoff members 154 form an opening 153 facing the strap 120, such that the upper portion extends perpendicular to the strap so the strap may enter the aperture.

Beneath the upper portion 152, and at the level of the upper surface 106 of the cover 100 is an aperture 156. Positioned between the aperture 156 and the upper portion 152 is an interference member 158. Interference member 158 is in the form of a protrusion that is sized and configured to fit within the valleys 151 between the ribs 150 of the strap 120. As such, the interference member 158 may be configured as a rounded bump, semi-circular rod, or the like. It will be appreciated that the interference member 158 shown in FIG. 12 is a rounded bump, and that a semi-circular rod in that orientation would extend in length between the standoff member is 154.

Figure 3:
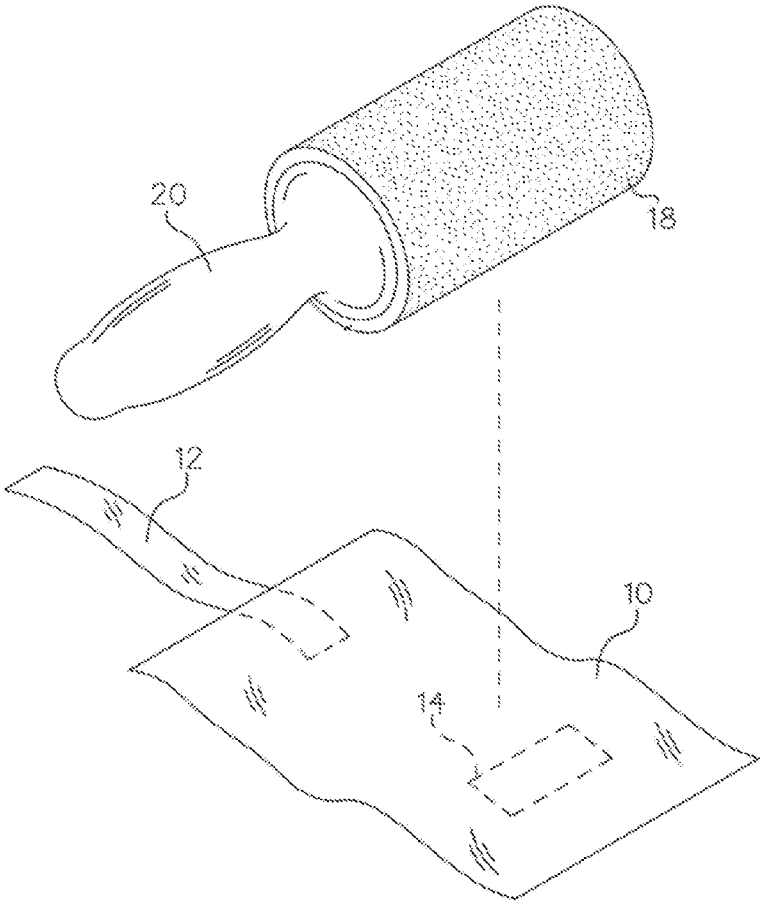
FIG. 3 is an exploded view of an embodiment of the present invention.
Figure 4:
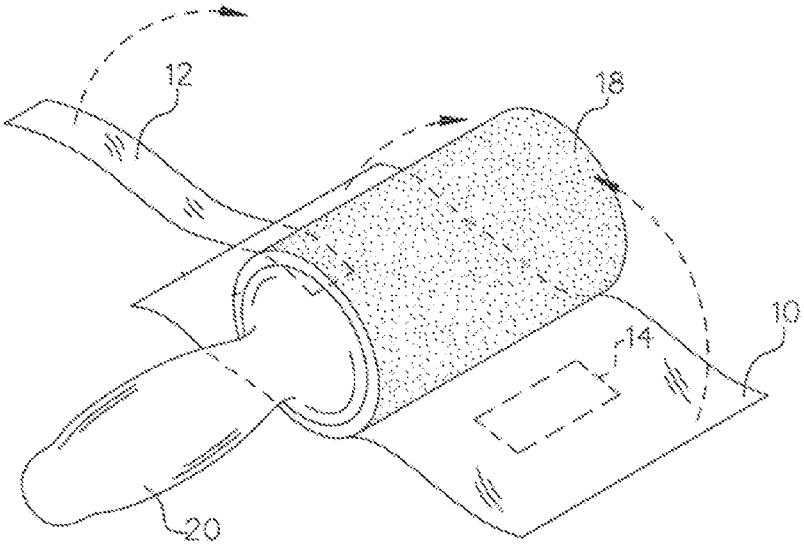
FIG. 4 is a perspective view illustrating the application of the present invention.
Figure 5:
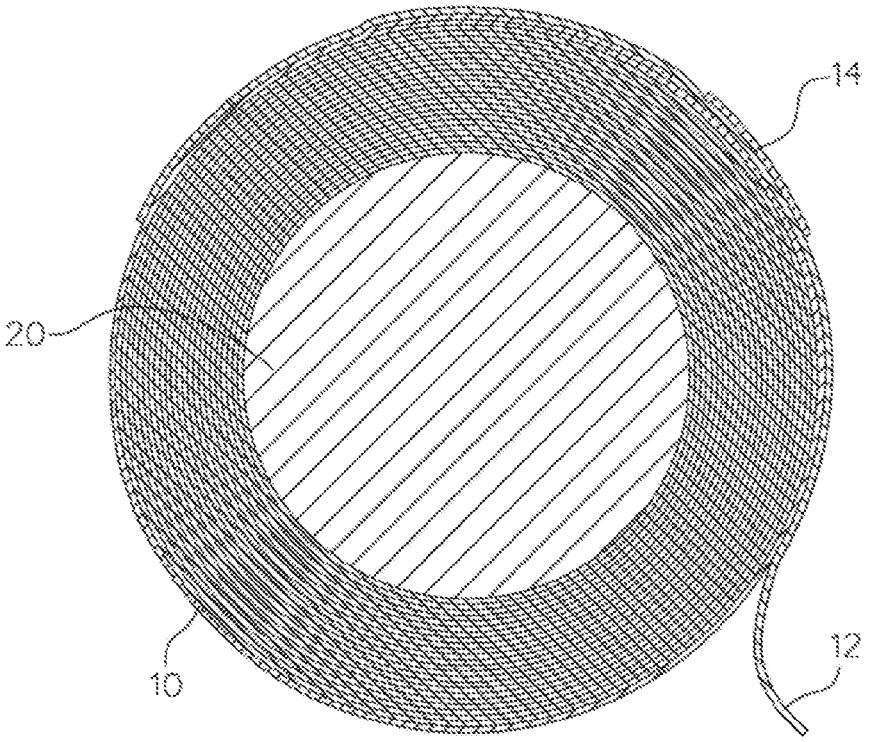
FIG. 5 is a section view taken from 5-5 of FIG. 1.
Figure 6:
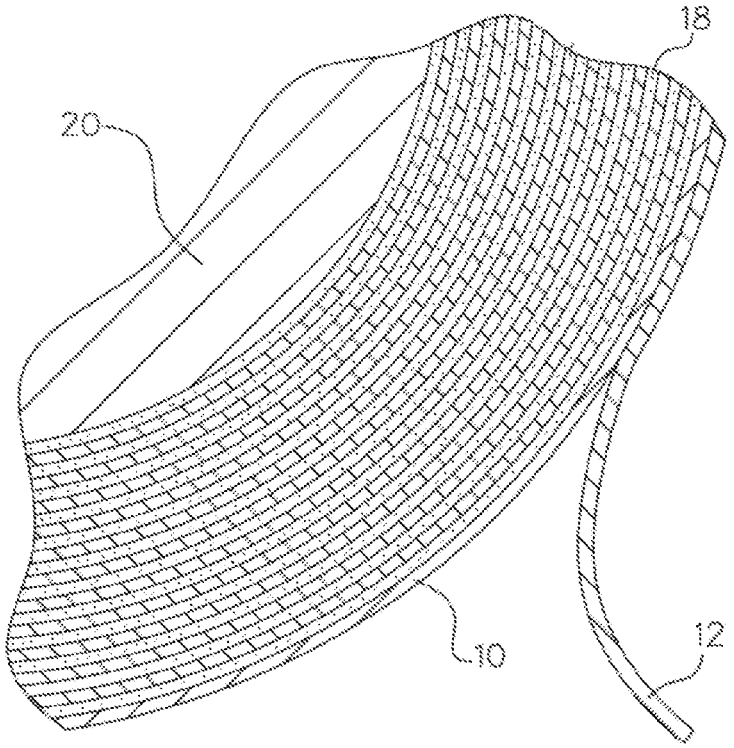
FIG. 6 is an enlarged section view of a portion of FIG. 5.
Figure 7:
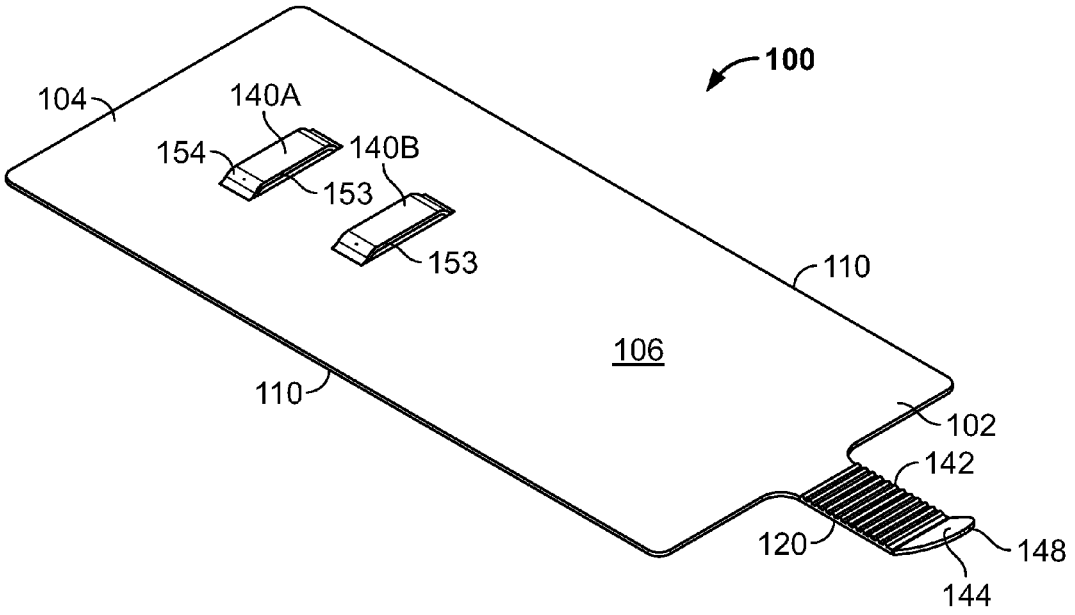
FIG. 7 is a perspective view of a further embodiment of the present invention.
Figure 8:
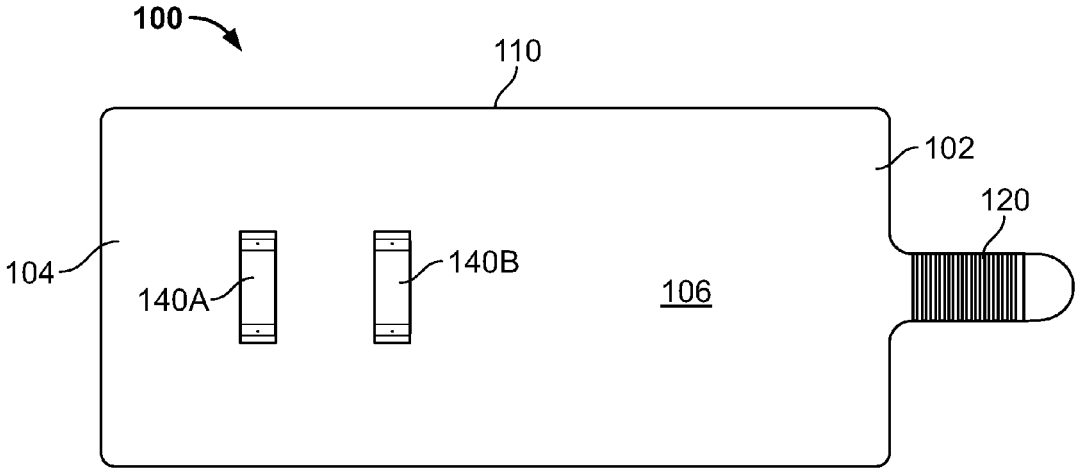
FIG. 8 is a top plan view of the embodiment of the invention shown in FIG. 7.
Figure 9:
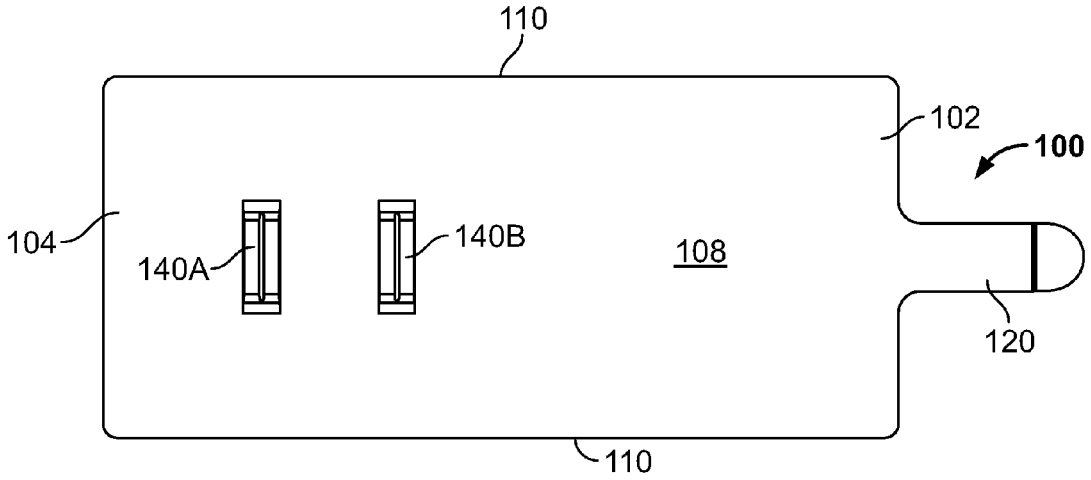
FIG. 9 is a bottom plan view of the embodiment of the invention shown in FIG. 7.
Figure 10:
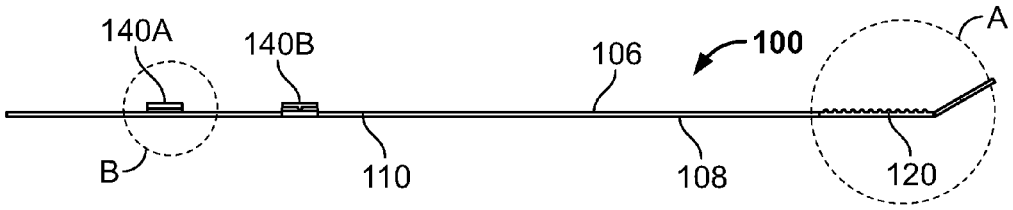
FIG. 10 is a side view of the embodiment of the invention shown in FIG. 7.

As with the prior embodiments, the cover 100 is designed to wrap around a lint roller 20 covering the adhesive tape 18, as shown in FIG. 3 and others. To secure the cover 100 upon the lint roller 20, and after wrapping the cover around the lint roller, one takes the distal end 148 of the strap 120 and threads it through the opening 153 of either connector 140A or 140B. In doing so, the ribs 142 will rub against the interference member 158, temporarily pushing the strap 120 toward the aperture 156. When the strap 120 and cover 100 is sufficiently taught for safe keeping, one may release the strap where friction or interference between fine interference member 158 and the ribs 150 will hold the strap securely, and therefore hold the cover, in place. To release the cover 100 from the lint roller 20, one may pull the strap 120 back through the respective connector 140A, 140B. It will be appreciated that engineering analysis of the materials of construction and sizes of the respective members can optimize the tension required to achieve securement and release of the cover 100.

Although the invention herein has been described with reference to particular embodiments, it is to be understood that these embodiments are merely illustrative of the principles and applications of the present invention. It is therefore to understood that numerous modifications may be made to the illustrative embodiments and that other arrangements may be devised without departing from the spirit and scope of the present invention as defined by the appended claims.

What is claimed is:

1. A lint remover cover comprising:

a substantially flat sheet having a first end, a second end, an upper surface, and a lower surface;

a strap extending from the first end of said sheet, said strap including at least one first interference member; and a connector attached to said sheet, the connector forming an opening defined in part by an upper portion positioned above and generally parallel to the upper surface of said sheet, the connector having a second interference member adapted to interfere with said at least one first interference member when said strap is positioned substantially parallel to said upper surface and through said opening, such that said strap may be releasably retained by said connector.

2. The lint remover cover of a wherein the substantially flat sheet is made of silicone.

3. The lint remover cover of claim 1, wherein the connector comprises a first end and a second end each attached to the upper surface of said sheet.

4. The lint remover cover of claim 3, wherein the connector is substantially perpendicular to a portion of the strap in the opening.

5. The lint remover cover of claim 1, wherein said at least one first interference member is a series of first interference members.

6. The lint remover cover of claim 5, wherein said series of first interference members is a series of ribs.

7. The lint remover cover of claim 1, wherein said portion of said connector adapted to interfere with said at least one first interference member is a protrusion.

8. The lint remover cover of claim 1, wherein said at least one first interference member is a series of ribs separated by valleys and said second interference member is adapted to fit into one of said valleys.

9. The lint remover cover of claim 1, further comprising a second connector attached to said sheet, the second connector having a portion adapted to interfere with said at least one first interference member such that said strap is releasably retained by either said connector or said second connector.

10. A method of covering a lint roller comprising:

providing a cover comprising:

a substantially flat sheet having a first end a second end, an upper surface, a lower surface, and an edge about the perimeter;

a strap attached to the edge on the first end, the strap including an interference member; and a connector attached to the sheet near the second end, the connector having an opening through which the strap may be threaded, the opening including a portion adapted to interfere with the interference member;

wrapping the cover around the lint roller so that the lower surface is facing towards an adhesive tape of the lint roller;

threading the strap through the opening of the connector such that the portion of the connector adapted to interfere with the interference member does so, thereby securing the cover on the lint roller.

11. The method of claim 10, wherein the substantially flat sheet is made of silicone.

12. The method of claim 10, wherein the interference member is a series of interference members.

13. The method of claim 12, wherein the portion of the connector adapted to interfere with the interference member serially interferes with a plurality of interference members as the strap is threaded through the connector.

14. The method of claim 10, further comprising a second connector attached to the sheet near the second end, the second connector having an opening through which the strap may be threaded, the opening including a portion adapted to interfere with the interference member;

wherein the step of threading is through either the connector or the second connector.

15. A kit comprising:

a lint roller having a cylinder with an outer layer of adhesive tape, a lint roller cover adapted to cover the outer layer of adhesive tape, the cover formed from a substantially flat sheet having a first end, a second end, a top surface, and a bottom surface; a strap extending from said first end, said strap including at least one interference member facing the same orientation as said top surface; and a connector associated with said top surface, said connector having a portion adapted to interfere with said at least one interference member such that said strap may be releasably retained by said connector to cover the outer layer of adhesive tape of the lint roller.

16. The kit of claim 15, further comprising a second lint roller.

17. The kit of claim 15, wherein said at least one interference member is a series of interference members.

18. The kit of claim 7, wherein said series of interference members are ribs.

19. The kit of claim 18, wherein said lint roller cover includes a second connector associated with said top surface.

20. The kit of claim 19, wherein said portion of the connector adapted to interfere with said at least one interference member is a protrusion.

* * * * *